US010981768B2

(12) United States Patent
Harris et al.

(10) Patent No.: US 10,981,768 B2
(45) Date of Patent: Apr. 20, 2021

(54) PRESSURIZED DISPENSING SYSTEM INCLUDING A PLASTIC BOTTLE AND PROCESS OF MINIMIZING THE FORMATION OF STRESS CRACKS IN A PLASTIC BOTTLE

(71) Applicant: S.C. Johnson & Son, Inc., Racine, WI (US)

(72) Inventors: Kimberly Harris, Miwaukee, WI (US); David Buri, Union Grove, WI (US); Jeffrey Christianson, Oak Creek, WI (US); Cassandra Blair, Kenosha, WI (US); Niles Stenmark, Franklin, WI (US); Steven Hooper, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 103 days.

(21) Appl. No.: 16/211,555

(22) Filed: Dec. 6, 2018

(65) Prior Publication Data

US 2019/0177147 A1 Jun. 13, 2019

Related U.S. Application Data

(60) Provisional application No. 62/596,455, filed on Dec. 8, 2017.

(51) Int. Cl.

| | |
|---|---|
| ***B67C 3/06*** | (2006.01) |
| ***B65B 31/00*** | (2006.01) |
| ***B65B 43/54*** | (2006.01) |
| ***B65D 83/14*** | (2006.01) |

(52) U.S. Cl.

CPC ..... *B67C 3/06* (2013.01); *B65B 31/003* (2013.01); *B65B 43/54* (2013.01); *B65D 83/75* (2013.01)

(58) Field of Classification Search

CPC ..... B65D 11/24; B65D 11/22; B65D 1/44; B65D 1/42; B65D 1/023; B65D 1/0223; B65D 79/005; B65D 83/75; B65D 41/12; B65D 41/10; B65D 51/1644; B65D 51/1661; B67C 3/08; B67C 3/06;

(Continued)

(56) References Cited

U.S. PATENT DOCUMENTS 2,837,245 A * 6/1958 Grebowiec ..... B65D 83/38 222/184

4,285,230 A 8/1981 Hartness (Continued)

OTHER PUBLICATIONS

Sinotech, "Blow & Rotational Molding", retrieved Mar. 27, 2019, http://www.sinotech.com/resources/tutorials/blow-rotational-molding/.

(Continued)

*Primary Examiner* — Robert J Hicks

(57) ABSTRACT

A pressurized dispensing system including a plastic bottle and a method of minimizing the formation of stress cracks in a plastic bottle that is a part of a pressurized dispensing system. In a method of manufacturing the pressurized dispensing system, a plastic bottle is filled with a liquid, a valve is crimped onto the plastic bottle, and the plastic bottle is filled with gas so as to pressurize the plastic bottle. The plastic bottle is supported only in the finish region throughout the liquid filling, valve crimping, and gas filling steps. The filled and pressurized plastic bottle is substantially free of stress cracks.

6 Claims, 4 Drawing Sheets

(58) Field of Classification Search
CPC ..... B65B 31/003; B65B 3/00; B65B 31/02; B65B 31/00
USPC ..... 215/42, 381, 324, 327, 311, 307; 220/669, 675, 309.1; 53/473, 470, 467, 53/403
See application file for complete search history.

(56) References Cited

U.S. PATENT DOCUMENTS 4,813,561 A * 3/1989 Ochs ..... B65D 41/3409 215/252
4,939,890 A 7/1990 Peronek et al.
4,969,577 A * 11/1990 Werding ..... B65D 83/14 141/3
5,198,248 A * 3/1993 Krishnakumar .... B29C 49/0073 215/373
5,829,614 A * 11/1998 Collette ..... B29C 49/12 215/375
6,463,964 B2 10/2002 Clusserath
6,548,133 B2 * 4/2003 Schmidt ..... B29C 45/1646 215/12.2
8,950,611 B2 * 2/2015 Derrien ..... B65D 79/005 215/373
2005/0172580 A1 8/2005 Krulitsch
2005/0260371 A1 * 11/2005 Shi ..... B29C 49/08 428/35.7
2008/0210334 A1 9/2008 Lupi et al.
2008/0283483 A1 * 11/2008 Kim ..... B65D 23/02 215/12.2
2009/0050599 A1 * 2/2009 Martin ..... B65D 23/001 215/376
2010/0101183 A1 4/2010 Beisel
2010/0212773 A1 8/2010 Clusserath et al.
2012/0211457 A1 * 8/2012 Patel ..... B65D 83/38 215/42
2012/0241457 A1 * 9/2012 Hallman ..... B65D 83/38 220/309.1
2016/0264344 A1 9/2016 Clark et al.
2017/0057724 A1 * 3/2017 Bates ..... B65D 21/0231
2017/0158480 A1 6/2017 Bandini et al.
2017/0341849 A1 * 11/2017 Wolak ..... B65D 83/28
2018/0265243 A1 * 9/2018 Gutekunst ..... B65D 1/42
2019/0225355 A1 * 7/2019 Siegl ..... B29B 11/14
2020/0156916 A1 * 5/2020 Knott ..... B67C 3/06

OTHER PUBLICATIONS

International Search Report and Written Opinion dated Apr. 12, 2019, issued in corresponding International Patent Application No. PCT/US2018/64481.

* cited by examiner

PRESSURIZED DISPENSING SYSTEM INCLUDING A PLASTIC BOTTLE AND PROCESS OF MINIMIZING THE FORMATION OF STRESS CRACKS IN A PLASTIC BOTTLE

This application claims the benefit of priority of U.S. Provisional Patent Application No. 62/596,455, file Dec. 8, 2017.

BACKGROUND

Field of the Invention

Our invention relates to a pressurized dispensing system and a process of minimizing the formation of stress cracks in a plastic bottle. More specifically, our invention relates to a pressurized dispensing system that includes a plastic bottle containing a product to be dispensed and a method of minimizing the formation of stress cracks in such a plastic bottle.

Related Art

Pressurized dispensing systems, such as systems used to dispense aerosol products, have conventionally included metallic (e.g., steel or aluminum) containers for containing the product under pressure before it is dispensed from the system. Examples of products that are dispensed with such systems include air fresheners, fabric fresheners, insect repellants, paints, body sprays, hair sprays, shoe or footwear spray products, whipped cream, and processed cheese. Recently, there has been increased interest in using plastic bottles as an alternative to metallic containers in pressurized dispensing systems because plastic bottles have several potential advantages. For example, plastic bottles may be easier and cheaper to manufacture than metallic containers, and plastic bottles can be made in a wider variety of interesting shapes than metallic containers. As another example, plastics bottles are generally easier to recycle than metallic containers.

One problem with using a plastic bottle to contain the product in a pressurized dispensing system, however, is environmental stress cracking in the plastic bottle. Environmental stress cracking is the tendency for cracks to form in the plastics over time as a result of different factors. Such stress cracking may be caused by stress factors in the plastic and the presence of a chemical agent. For example, in the case of pressurized plastic bottle, stress in the plastic may arise when the bottle is pressurized. Further, regions of the bottle may concentrate stress, such as corners and thick-to-thin transitions, with these regions therefore being more predisposed to localized environmental stress cracking when the bottle is pressurized. And when the stressed areas are contacted by a chemical agent, cracking will often occur.

We have found that environmental stress cracking in a plastic bottle may arise as a result of aspects of the process by which the plastic bottle is processed into a pressurized dispensing system. In particular, we have found that the load applied to the top end of the plastic bottle can be a significant driver of environmental stress cracking. For example, a significant load is applied to the top end of the bottle when a valve is crimped onto the bottle and when the bottle is pressurized with a gas propellant. In conventional processes, the base of the bottle for a pressurized dispensing system is supported on a surface during the valve crimping and pressurization operations. In the case of a plastic bottle, the load applied to the top end of the bottle is distributed throughout the bottle, including through the body region and the base region of the bottle. With some bottle designs, we believe that the load distributed to the base region of a plastic bottle causes the bottle to flex in the base region. The viscoelastic nature of polymer(s) making up the plastic is such that when a stress is introduced from the flexing, some of the molecules rearrange from an equilibrium state. Some of the energy from the induced stress is released when the load is removed. However, a portion of the molecules will remain in stressed state due to the rearrangement. Some of these molecules in the stressed state may subsequently return to equilibrium and thereby relieve stress, and a chemical agent (e.g., the product contained in the bottle) may accelerate this stress relief And when the stress is relieved, environmental stress cracking may occur.

Thus, it would be desirable to have a process and a system for making a pressurized dispensing system that includes a plastic bottle that does not distribute a top end load through the body region and base region of the plastic bottle.

SUMMARY OF THE INVENTION

According to an aspect, our invention provides pressurized dispensing system comprising a plastic bottle. The plastic bottle includes a base at a bottom end of the plastic bottle, a body extending about an axis of the plastic bottle from the base towards a top end of the plastic bottle, a finish region extending about the axis of the plastic bottle from the body to the top end of the plastic bottle, and a composition contained in the plastic bottle. The plastic bottle is pressurized to at least about 80 psig. When the plastic bottle is filled with the composition and pressurized, the plastic bottle is supported only in the finish region.

According to another aspect, our invention provides a process of minimizing the formation of stress cracks in a plastic bottle that is a part of a pressurized dispensing system. The method comprises filling the plastic bottle with a liquid, crimping a valve onto the plastic bottle, and filling the plastic bottle with gas so as to pressurize the plastic bottle. The plastic bottle is supported only in the finish region throughout the liquid filling, valve crimping, and gas filling steps.

According to another aspect, our invention provides a system for manufacturing dispensing systems that include plastic bottles, with each of the plastic bottles including a finish region, a body region, and a base region. The system comprises a liquid filling station configured to provide at least one liquid to the plastic bottles, a valve crimping station configured to crimp valves to the plastic bottles, a pressure filling station configured to pressurize the plastic bottles with gas to a least about 80 psig, and a bottle carrier line including bottle holders that are configured to only support the finish regions of the bottles.

BRIEF DESCRIPTION OF THE DRAWINGS

FIG. 5(*b*) is a front view of the bottle holder shown in FIG. 5(*a*).

FIG. 5(*c*) is a side view of the bottle holder shown in FIG. 5(*a*).

DETAILED DESCRIPTION OF THE INVENTION

Our invention generally relates to a process and a system for manufacturing a pressurized dispensing system that includes a plastic bottle.

By "pressurized" we mean that the pressure inside of the plastic bottle of the dispensing system is significantly above atmospheric pressure such that the pressure inside of the bottle acts to force the product out of the plastic bottle when the dispensing system is activated. In embodiments of our invention, the plastic bottle may be pressurized between about 80 psig to about 160 psig. In particular embodiments of our invention, the plastic bottle may be pressurized from about 110 to about 140 psig.

Figure 1:
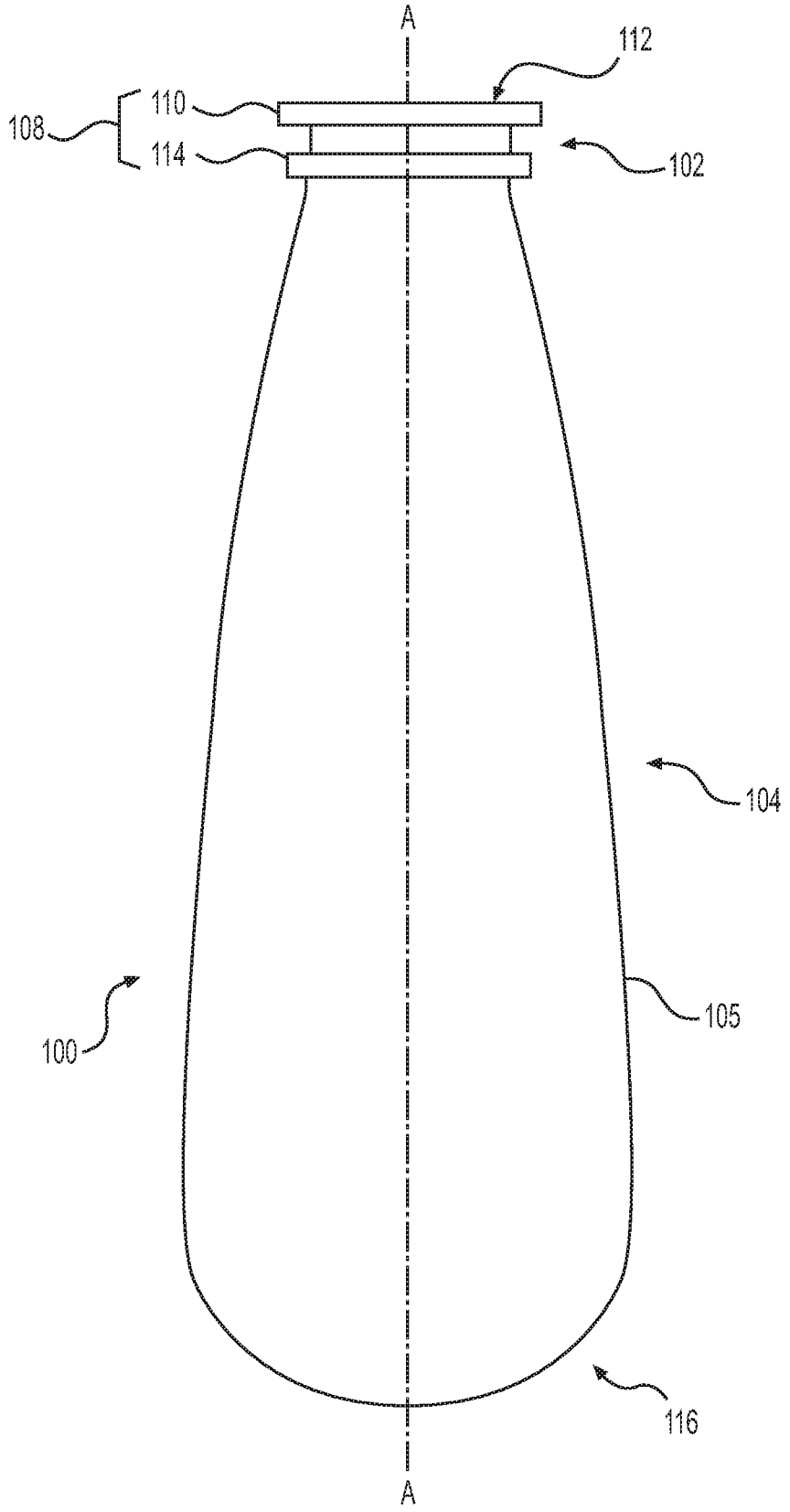
FIG. 1 is a side view of a plastic bottle that can be used in embodiments of our invention.

FIG. 1 shows a bottle 100 for use in a pressurized dispensing system according to an embodiment of our invention. The bottle 100 is made from a plastic material. The bottle 100 may be formed using, for example, injection, compression, and/or blow molding techniques, which are well known in the art. In injection and blow molding processes, a plastic preform is first formed using injection molding. The plastic preform is subsequently heated and stretch blow molded into the final shape of the bottle 100. The injection and blow molding steps in such a process can take place in a single stage with one mold, or the injection and blow molding steps can be separated into separate stages with multiple molds. Some examples of such plastics that can be used to form the bottle 100 include branched or linear polyethylene terephthalate (PET), polycarbonate (PC), polyethylene naphthalate (PEN), nylon, polyethylene furanoate (PEF), polyolefins (PO) such as polyethylene (PE) and polypropylene (PP), and other polyesters, and blends thereof.

It should be noted that the general shape, size, and proportions of the bottle 100 shown in FIG. 1 are merely exemplary. Indeed, one of the advantages of using plastic to form the bottle 100 is that the plastic may be molded into a wide variety of shapes and sizes. In this regard, while the bottle 100 has a rounded base 116 to which a base cup will be applied in order to provide a flat surface at the bottom of the bottle 100 (as discussed below), in alternative embodiments, the base 116 of the bottle 100 may have a different shape, such as a shape that forms a flat surface upon which the bottle 100 can rest without the addition of a base cup.

The bottle 100 includes a top end 102, a base region 116, and a body region 104, with a sidewall 105 between the top end 102 and base region 116. In this embodiment, the body region 104 of the bottle 100 is round and extends about an axis A. The top end 102 includes a finish region 108 having a crimp ring 110 surrounding an opening 112 of the bottle 100. A valve (not shown) can be crimped to the crimp ring 110 in order to securely attach the valve to the bottle 100, as will be described below. The product contained in the bottle 100 can thereby be dispensed through the valve. The finish region 108 also includes a transfer ring 114 positioned below the crimp ring 110. Notably, in embodiments of our invention, the finish region may be substantially thicker than the body and base of the bottle. Also, as will be discussed in detail below, during a process using the bottle 100 to create a pressurized dispensing system, the bottle 100 may be gripped at or immediately below the transfer ring 114 to transfer the bottle 100 between processing stations.

Figure 2:
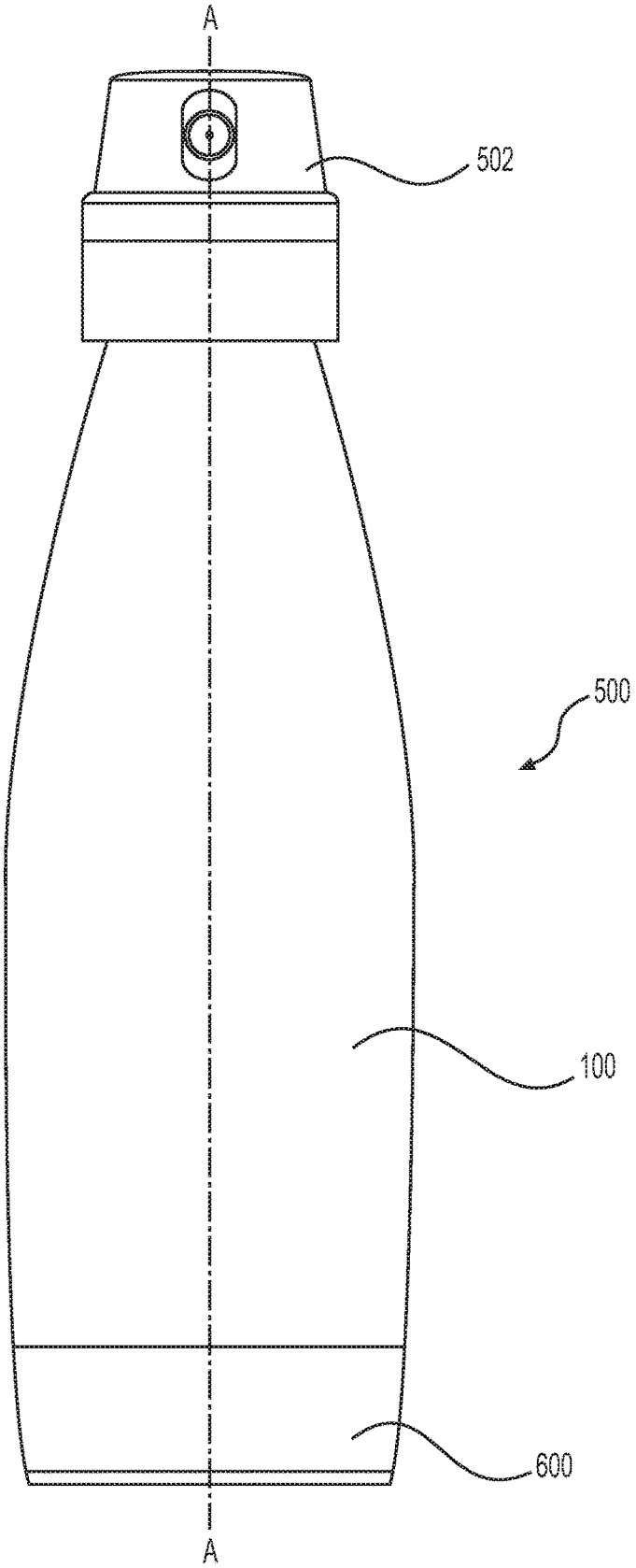
FIG. 2 is a side view of a dispensing system that includes a plastic bottle as shown in FIG. 1.

An example of a pressurized dispensing system 500 using the plastic bottle 100 is shown in FIG. 2. In the system 500, a base cup 600 is attached to the rounded base 116 of the bottle 100. The base cup 600 allows the system 500 to stand up-right on a flat surface despite the rounded base 116. At the top of the system 500 is a spray mechanism 502, which includes a valve. The pressurized product contained within the bottle 100 is dispensed through the spray mechanism 502. Although not shown, a cap may be provided over the spray mechanism 502. Those skilled in the art will recognize the wide variety of valves, spray mechanisms, and caps that could be used with a pressurized dispensing system of the type described herein.

In a specific embodiment of our invention, the system 500 is used to dispense an air freshening composition. Examples of formulations for the air freshening composition can be found in commonly assigned U.S. Patent Application Pub. No. 2016/0264344 A1, which is hereby incorporated by reference in its entirety.

After the plastic bottle 100 is initially formed, for example, using injection molding and blow molding, the plastic bottle 100 is then further made into the pressurized dispensing system 500. It should be noted, however, that the plastic bottle 100 need not be immediately converted to a pressurized dispensing system at the time and location as its initial creation. Rather, the plastic bottle 100 may be created at one time and place, and then moved to another location for the further processing described below. Moreover, further processing steps can be conducted between the initial bottle formation and the subsequent processing described below, such as the addition of the base cup 600 to the bottle 100.

Figure 3:
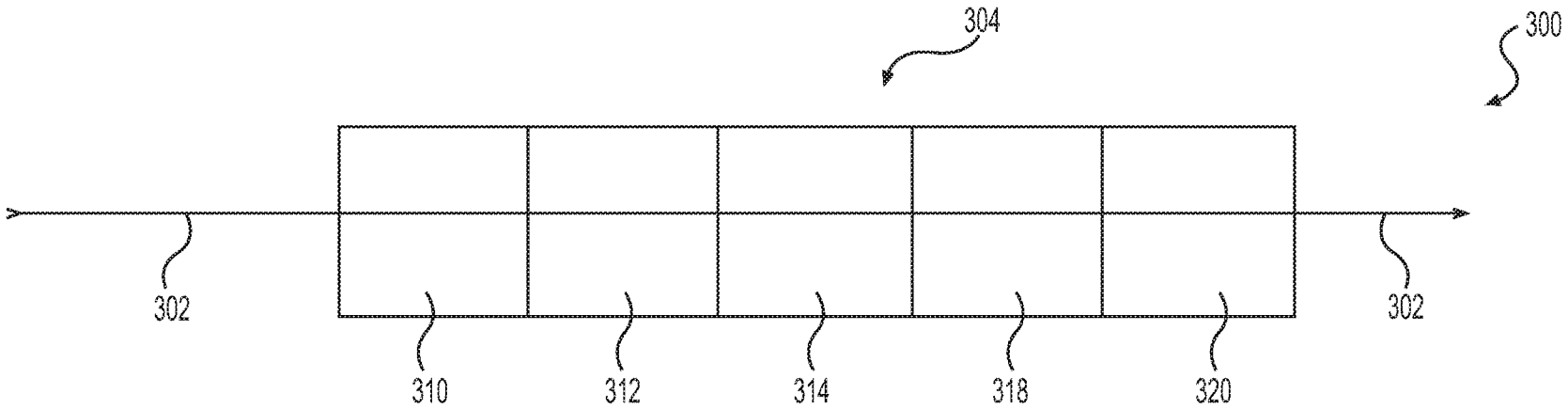
FIG. 3 is a schematic view of processing stations in a part of a manufacturing line for making a dispensing system according to an embodiment of our invention.
Figure 4:
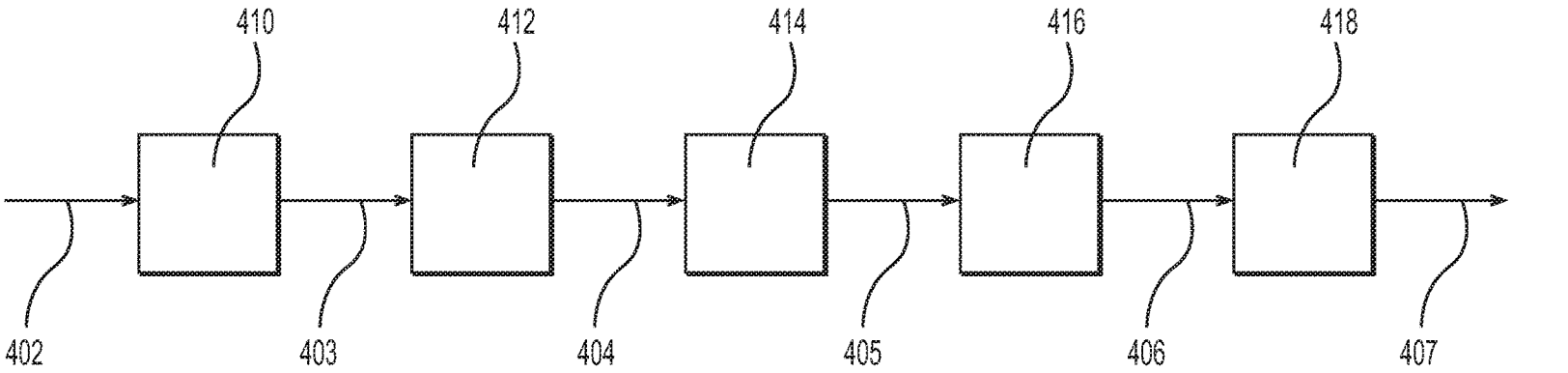
FIG. 4 is a schematic view of processing stations in a part of a manufacturing line for making a dispensing system according to another embodiment of our invention.

FIGS. 3 and 4 show two alternative examples of parts of manufacturing process lines according to embodiments of our invention. In the depicted sections of the manufacturing process lines 300 and 400, plastic bottles for pressurized dispensing systems (as described above) are filled with liquid product, valves are crimped to the tops of the bottles, and the bottles are pressurized with gas to the final pressure of the dispensing systems. As will be discussed in detail below, the section of the process line 300 includes one operation structure 304 in which liquid filling, valve placement and crimping, pressurization, and pressure checking steps take place. The depicted section of the process line 400 is an alternative to the depicted section of the process line 300. As will described below, the section of the process line 400 includes separate units 410, 412, 414, 418, and 420 where liquid filling, valve placement and crimping, pressurization, and pressure checking operations take place.

Figure 5A:
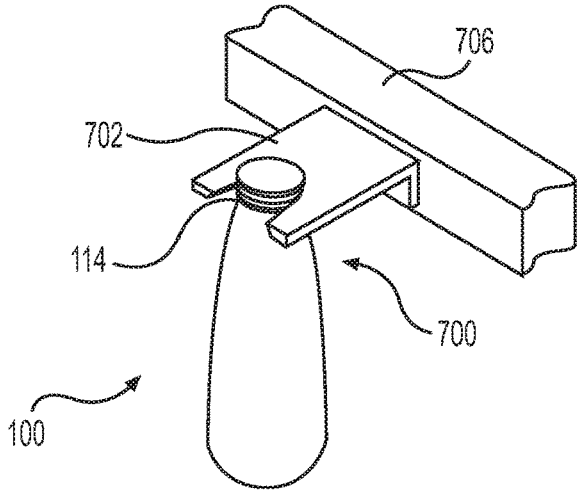
FIG. 5(*a*) is a perspective view of a bottle holder according to an embodiment of our invention.
Figure 5B:
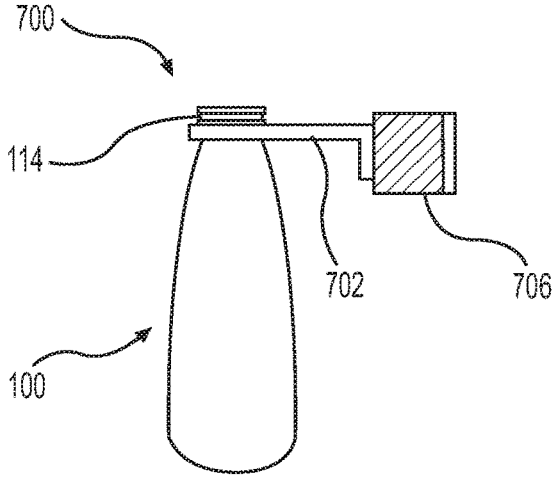
Figure 5C:
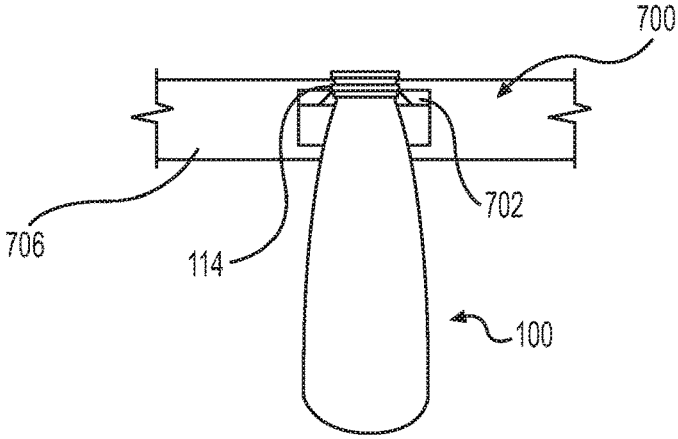

Referring to FIG. 3, a bottle carrier line 302 is provided to move the plastic bottles through the operation structure 304. According to one aspect of our invention, the bottle carrier line 302 is configured to only support the plastic bottles in the finish regions of the bottles. That is, the bottle carrier line 302 includes a structure that holds the bottles in their finish regions but the bottle carrier line 302 does not include, for example, a structure supporting the bases of the bottle. FIGS. 5(*a*), 5(*b*), and 5(*c*) show an example of a bottle holder 700 that can be used with the bottle carrier line 302. The bottle holder 700 includes a support structure 702 on which the transfer rings 114 of the bottles 100 are supported. The bottle holder support structure 702 is connected to a moving transport structure 706 to thereby form part of the bottle carrier line 302 that moves the bottles 100 during the parts of the manufacturing processes described herein. Those skilled in the art will recognize numerous alternative configurations to the bottle holder and transport structure depicted in FIGS. 5(*a*), 5(*b*), and 5(*c*). For example, the transport mechanism could include holders with grips that are spring loaded, pneumatically, or hydraulically operated so as to engage and disengage the bottles. As another example, the transport mechanism could include elevated pucks that are positioned up to the finish regions of the bottles. What is important in this aspect of our invention is that the bottles are supported in their finish regions rather than other regions of the bottles.

The first part of the operation structure 304 in the section of the manufacturing line 300 is the liquid filling unit 310. In this unit the bottles are filled with the liquid component(s) of the product to be dispensed from the pressurized dispensing systems. The liquid filling unit 310 can include multiple stations each having a nozzle for providing a liquid to the bottles. For example, for aerosol dispensing systems, the bottles may be filled with a fragrance intermediate composition through one nozzle in one station of the liquid filling unit 310 and are filled with water through a second nozzle in a second station of the liquid filling unit 310. Additional stations could also be provided in the liquid filling unit 310 in order to add further liquids to the bottles.

The liquid filling unit 310 can be specifically configured to prevent contamination of the bottles during the pressurized dispensing system manufacturing process. For example, the liquid filling unit 310 can be designed to minimize, if not eliminate, any liquid from contacting the outsides of the bottles. As will be demonstrated below, we have found that even a small amount of liquid contacting the outer surfaces of the bottles during the manufacturing process can result in those parts of the bottles becoming highly susceptible to environmental stress cracking. This is particularly the case with fragrance compositions that are often part of aerosol sprays. One example of a configuration of the liquid filling unit 310 that minimizes the contamination of the bottles is having the nozzles be designed to minimize or eliminate dripping or meniscus formation and to ensure that the liquids are dispensed in compact streams directed toward the centers of the insides of the bottles. For example, the nozzle may having openings, holes, screens, etc., that specifically orientate the liquid towards the centers of the bottles. Such nozzle designs are different from conventional bottle filling nozzle designs which dispense liquids in a wide spray outward from the centers of the bottles, and, thus, sometimes result in liquid being sprayed onto the outsides of the bottles.

It will be further be appreciated by those skilled in the art that by using a bottle holding structure that supports the finish regions of the bottles, such as the bottle holders described above, the bottles may be more closely and accurately supported relative to the nozzles in the liquid filling unit 310 than in conventional bottle filling systems where the bottles are supported at their bases. Thus, by supporting the bottles in their finish regions, our invention reduces the possibility of liquid contacting the outsides of the bottles and the potential environmental stress cracking that might result from such contamination.

After the liquid filling unit 310 of the operation structure 304, the bottles are moved to a valve application unit 312. In the valve application unit 312, valves are placed and inserted on the top ends of the bottles. The valve application unit 312 may be configured to place and insert the valves to the bottles in one step, or the valve application unit 312 may be configured to perform a multi-step placement and insertion process, e.g., a process wherein one device in the valve application unit 312 inserts the valves to the bottles, and then another device in the valve application unit 312 helps to seat the valves in the bottles. It should be noted in this regard that by supporting the bottles in their finish regions as described above, the bottles may be more accurately positioned within the valve application unit 312 as compared to base supported bottles. Thus, supporting the bottles in the finish regions ensures precision in the placement of the valves on the bottles. At the end of the valve application unit 312 the valves are ready to be crimped to the bottles.

The valves themselves may take different forms depending on the particular type of dispensing system being manufactured. For example, the valves may be external crimping type, wherein the valves are crimped to the exterior of the bottles (as will be described below). In other embodiments, however, the valves may be internal crimping type, wherein parts of the valves are set to the insides of the finish regions of the bottles, and the valves are subsequently crimped to the insides of the bottles. Additionally, the valves may be used in conjunction with further structures, such as gaskets, which can also be set to the bottles in the valve application unit 312. Details of valves that may be used with the plastic bottles in embodiments of our invention can be seen in commonly assigned U.S. patent application Ser. No. 15/367,651, which is incorporated by reference in its entirety.

The bottles are moved by the bottle carrier line 302 from the valve application unit 312 to the valve crimping unit 314. In the valve crimping unit 314 the valves are crimped onto the tops of the bottles so that the valves become fixed to the bottles. When the bottles and valves are configured for external crimping, the valves can include skirts that are wrapped around the crimp rings during the crimping operation. Details of a valve being crimped to a plastic bottle can be found in commonly assigned U.S. Patent Application Nos. 2015/0034584 A1, which is incorporated by reference in its entirety.

Those skilled in the art will recognize the variety of configurations that can be used with the valve crimping station 314. Indeed, it will be appreciated that multiple factors affect the valve crimping operation, including the crimping pressure, crimp depth, the crimp diameter, bottle finish design, sealing surface, valve design, design of gaskets to be used with the bottle, etc. With such factors in mind, the configuration of the valve crimping unit 314 can tailored to achieve desired crimping operations. In embodiments of our invention, the valve crimping unit 314 includes a plurality of collets that close to a crimp diameter during the crimping process, and a crimp plate that moves downward to a crimp depth during the crimping process. In another embodiment of our invention, the valve crimping unit 314 includes a one-piece structure that includes a plurality of segmented sections, which thereby function in a manner analogous to a plurality of collets. The collets bend parts of the valves (e.g., skirts) around the crimp rings at the tops of the finish regions of the bottles, while the internal crimp plate pushes down on a top surface of the valves. With the crimp diameter and the crimp depth properly adjusted for particular plastic bottles and valves, the valves are effectively crimped onto the tops of the bottles in the crimping unit 314. Those skilled in the art will recognize that, in other embodiments of our invention wherein an internally crimped valve is used, the collets of the valve crimping unit 314 are configured to open inside of the bottle to thereby crimp the finish regions on the insides of the bottles.

It is notable that, during the crimping operation, a significant force may be imparted to the top ends of the plastic bottles, in particular, a significant force resulting from the combination of the weight of the equipment and the crimping pressure applied to achieve a proper crimp. As discussed herein, by supporting the bottles in their finish regions during the valve crimping operation, our invention mitigates stress cracking in the plastic bottles resulting from this top end force.

After completion of the valve crimping operation, the bottles are moved by the bottle carrier line 302 from the valve crimping unit 314 to the pressure filling unit 318. The pressure filling unit 318 provides gas into the plastic bottles so that the bottles are pressurized to a desired pressure. For example, when the plastic bottles are to be used in aerosol dispensing systems, the pressure filling unit 318 can add propellant gas to the plastic bottles until a pressure of at least about 80 psig, and up to about 160 psig, is reached. In specific embodiments, the plastic bottles are pressurized to between about 110 psig and about 140 psig. In some embodiments of our invention, the bottles in aerosol dispensing systems are pressurized in multiple steps, such as a two step procedure where the gas is volumetrically filled in a first operation in the pressure filling unit 318, with the bottles then being pressurized to an equilibrium pressure in a second operation in the pressure filling unit 318.

Examples of propellant gases that can be used in embodiments of our invention include compressed gases, such as nitrogen, air, argon, nitrous oxide, inert gases, and carbon dioxide. Other examples of propellant gases that can be used in embodiments of our invention include liquefied petroleum gas-type propellants, such as hydrocarbons and hydrofluorocarbons. Those skilled in the art will appreciate the various configurations and techniques that may be used in the pressure filling station 318 to fill the plastic bottles with such gases. For example, in embodiments of our invention, the gas is provided into the plastic bottles using through-the-valve or through-and-around-the-valve techniques. In the case of a through-and-around-the valve process, propellant gas is forced into the bottle through and around the stem of the valve by a filling apparatus that fits over the valve, with the apparatus depressing the valve such that the gas is introduced under pressure into and around the valve stem. Other techniques known in the art for providing a propellant gas to a bottle may also be used.

After the pressure filling unit 318, the bottles may be moved by the bottle carrier line 302 to a pressure checking unit 320. In the pressure checking unit 320 the plastic bottles are checked to ensure that each bottle has an appropriate pressure for the desired dispensing system. Techniques for checking the pressure of pressurized bottles are well known in the art. It should also be noted, however, that a pressure checking unit is not required in all embodiments of our invention. For example, in some embodiments instead of a pressure checking unit, a water bath may be used to ensure that the pressurized bottle is not leaking. Further, the pressure checking unit can be separated from the operation structure 304 in other embodiments of our invention.

FIG. 4 shows an alternative example of a section of a manufacturing process line 400 according to embodiments of our invention. The process line 400 differs from the process line 300 in that, instead of having a single operation structure 304, the operating stations in the process line 400 are separated from each. Thus, multiple bottle carriers 402, 403, 404, 405, 406, and 407 (each of which may have the same configuration as the bottle carrier line 302 described above) transport the bottles between the stations in the process line 400, and the bottles are moved into and out of the stations using standard bottle transferring techniques. In this regard, groups of bottles can be indexed together between the carriers and the stations.

The depicted part of the process line 400 includes a liquid filling station 410, a valve application station 412, a valve crimping station 414, a pressure filling station 416, and a pressure checking station 418. Although the stations are separated in the process line 400, the stations themselves can have substantially similar configurations as the corresponding units in the operation structure 304 described above. Moreover, as in the process line 300, the bottles are only supported in their finish regions both on the carriers 402, 403, 404, 405, 406, and 407 and in the stations 410, 412, 414, 416, and 418 in the process line 400.

It should also be noted that the specific processing units and stations in the sections of the manufacturing lines described and depicted above are merely exemplary, and that different configurations of processing units and stations may be used in embodiments of our invention. For example, instead of a valve crimping station and a pressure filling station configured for the through-the-valve and the through-and-around-the-valve techniques described above, the crimping and pressurization stations could be combined into a single station that performs an under-the-cup pressurization process. Those skilled in the art will recognize that in an under-the-cup process, the propellant gas is forced under the valve cup and into the bottle just before the valve is crimped to the bottle. As another example of an alternative station configuration, the pressure filler and pressure checker stations could be combined into a single station, wherein the bottles are pressurized in one part of the station, and then the pressures of the bottles are checked in another part of the station. As with the separate pressure filler and pressure checker stations, in the combined pressure filler and pressure checker station the bottles are supported by bottle holders in their finish regions but not in other regions of the bottles. Thus, the reduction in stress cracking resulting from the reduction of top load force distribution in the bottles can be achieved with the combined pressure filler and pressure checker station.

As discussed above, we believe that by continuously holding the plastic bottles in their finish regions during the parts of the manufacturing processes described herein, there will be less incidence of stress cracking in the resulting pressurized dispensing systems that include the plastic bottles. As discussed, supporting the plastic bottles in the finish regions provides for better management of the forces applied during the parts of the process lines 300 and 400, which in turn can reduce stress cracking in the bottles. Further, supporting the plastic bottles in the finish regions will reduce the possibility of contamination, e.g., product inadvertently contacting the outsides of the bottles, which can cause stress cracking. And continuously holding the plastic bottles in their finish regions provides other advantages as well, such as accuracy in valve placement and insertion, as discussed above.

A series of tests were conducted to demonstrate the reduction in environmental stress cracking resulting from techniques according to our invention. In these tests plastic bottles having a configuration as generally shown in FIG. 1 were created, and the bottles were used to create dispensing systems as generally shown in FIG. 2. The bottles were made from a PET resin using injection and blow molding, the bottles were filled with an air freshening formula, and the bottles were pressurized with nitrogen using a through-and-around-the-valve technique such that the bottles reached a target pressure of about 155 psig. During the crimping and pressure filling operations, 25 bottles were supported in their finish regions, specifically, the transfer rings of the bottles were supported on bottle holders. For comparison, 25 bottles were supported with a surface positioned against base cups at the bases of the bottles (as in conventional processes). One month after production, the amount of environmental stress cracking was evaluated for the finish supported bottles and base supported bottles. Specifically, the amount of stress cracking in the bases and the neck regions (regions between the transfer rings and the body portions of the bottles) was evaluated in each bottle, with the stress cracking being assigned a rating of zero to five. A bottle was given a rating of zero if no cracks were observed, even with the aid of a microscope. A rating of one was indicative of shallow microcracks being observed at a low concentration (such cracks would not be apparent with unaided visual inspection). A rating of two was indicative of a moderate concentration of shallow microcracks being observed (such cracks would not be apparent with unaided visual inspection). Bottles were given a rating of three if there was a high concentration of microcracks and/or one or two deeper cracks existed (such cracks would be apparent without aided visual inspection). A rating of four indicated several deeper cracks, and a rating of five indicated a high concentration of deeper cracks being present, with the cracks extending through the wall thickness of the bottles. The results of the tests are shown in Tables 1 and 2 below.

TABLE 1

| Base Supported Bottles | | | |
|---|---|---|---|
| Stress Cracking in Neck Region | | Stress Cracking in Base Region | |
| Rating | % of Bottles | Rating | % of Bottles |
| 0 | 0 | 0 | 0 |
| 1 | 12.0 | 1 | 0 |
| 2 | 76.0 | 2 | 24.0 |
| 3 | 12.0 | 3 | 44.0 |
| 4 | 0 | 4 | 32.0 |
| 5 | 0 | 5 | 0 |

TABLE 2

| Finish Supported Bottles | | | |
|---|---|---|---|
| Stress Cracking in Neck Region | | Stress Cracking in Base Region | |
| Rating | % of Bottles | Rating | % of Bottles |
| 0 | 0 | 0 | 0 |
| 1 | 28.0 | 1 | 24.0 |
| 2 | 44.0 | 2 | 72.0 |
| 3 | 28.0 | 3 | 4.0 |
| 4 | 0 | 4 | 0 |
| 5 | 0 | 5 | 0 |

The testing results demonstrate that stress cracking, particularly in the base regions of the bottles, is greatly reduced when the bottles are supported in their finish regions during the valve crimping and pressurization processes. Moreover, stress cracking in the neck region did not significantly increase when the bottles were supported in their finish regions as opposed to being supported at their bases. As discussed, we believe that this reduction in stress cracking is a result of the top load forces being only distributed in the finish region when the bottles are supported in their finish regions as opposed to the forces being distributed through the body and base regions of the bottles when the bottles are supported at their bases during the valve crimping and pressurization processes.

As discussed above, we have found that if some of a liquid being filled into the bottles contacts the outsides of the bottles, those contaminated areas of the bottles may become highly susceptible to environmental stress cracking. We conducted a series of tests that demonstrate the problem of contamination and environmental stress cracking. In these tests air freshening compositions were contacted to the outsides of plastic bottles having configurations as described above. The air freshening compositions were in intermediate (concentrated) forms as the compositions were filled into the bottles, with the intermediate compositions being diluted with water in the bottles. The intermediate air freshening compositions were also applied to the outside finishes and the bases of the bottles using a toothpick, a small cotton swab, and a sponge. The bottles were pressurized to 130 psig. A control bottle was also filled and pressurized, but no composition was applied to the outside of the control bottle. For each of the conditions and control, 10 bottles were tested. Environmental stress cracking in the test bottles was then evaluated after one month in the same manner as the stress cracking testing described above. The results of the tests are shown in Tables 3 and 4.

TABLE 3

| Neck Region Contamination | | | | | | | |
|---|---|---|---|---|---|---|---|
| Toothpick Application | | Cotton Swab Application | | Sponge Application | | Control (no contamination) | |
| Rating | % of Bottles | Rating | % of Bottles | Rating | % of Bottles | Rating | % of Bottles |
| 0 | 0 | 0 | 0 | 0 | 0 | 0 | 80 |
| 1 | 0 | 1 | 0 | 1 | 0 | 1 | 0 |
| 2 | 10 | 2 | 0 | 2 | 0 | 2 | 10 |
| 3 | 30 | 3 | 60 | 3 | 0 | 3 | 10 |
| 4 | 60 | 4 | 40 | 4 | 100 | 4 | 0 |
| 5 | 0 | 5 | 0 | 5 | 0 | 5 | 0 |

TABLE 4

| Base Region Contamination | | | | | | | |
|---|---|---|---|---|---|---|---|
| Toothpick Application | | Cotton Swab Application | | Sponge Application | | Control (no contamination) | |
| Rating | % of Bottles | Rating | % of Bottles | Rating | % of Bottles | Rating | % of Bottles |
| 0 | 0 | 0 | 0 | 0 | 0 | 0 | 100 |
| 1 | 0 | 1 | 0 | 1 | 0 | 1 | 0 |
| 2 | 20 | 2 | 30 | 2 | 0 | 2 | 0 |
| 3 | 60 | 3 | 50 | 3 | 0 | 3 | 0 |
| 4 | 20 | 4 | 20 | 4 | 80 | 4 | 0 |
| 5 | 0 | 5 | 0 | 5 | 20 | 5 | 0 |

As indicated by the test results, even a small amount of contamination (e.g., the amount equivalent to a dot from a toothpick) on the outside of a plastic bottle can cause a high level of stress cracking in both the neck and the base of the bottle. It follows that the amount of contamination on the outside of a plastic bottle during a process of manufacturing a pressurized dispensing system with the plastic bottle should be minimized in order to minimize stress cracking in the bottle. As discussed above, by supporting the bottles in their finish regions during the liquid filling step, the bottles can be more closely and accurately positioned relative to the nozzles dispensing the liquids, and, thus, there is less potential contamination of liquid on the outsides of the bottles. Our invention can thereby decrease the incidence of stress cracking in plastic bottles of pressurized dispensing systems.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention described herein can be used in the commercial production of a pressurized dispensing systems. Such pressurized dispensing systems have a wide variety of uses, for example, in the market of aerosol products.

We claim:

1. A pressurized dispensing system comprising:

(A) a plastic bottle including:

(a) a rounded base at a bottom end of the plastic bottle;

(b) a body extending about an axis of the plastic bottle from the base towards a top end of the plastic bottle;

(c) a finish region extending about the axis of the plastic bottle from the body to the top end of the plastic bottle; and (d) a composition contained in the plastic bottle; and (B) a base cup attached to the bottom end of the plastic bottle, the base cup having a flat surface that allows the pressurized dispensing system to stand up-right, wherein the plastic bottle is pressurized to at least about 80 psig, and wherein, when the plastic bottle is filled with the composition and pressurized, the plastic bottle is supported only in the finish region such that the base of the plastic bottle is substantially free of stress cracks.

2. The pressurized dispensing system according to claim 1, wherein the plastic bottle is pressurized to between about 110 psig and about 140 psig.

3. The pressurized dispensing system according to claim 1, further comprising a valve crimped to the finish region.

4. The pressurized dispensing system according to claim 3, wherein the plastic bottle is only supported in the finish region when the valve is crimped to the finish region.

5. The pressurized dispensing system according to claim 1, wherein the composition is an air freshening composition.

6. A pressurized dispensing system comprising:

a plastic bottle including:

(a) a base at a bottom end of the plastic bottle;

(b) a body extending about an axis of the plastic bottle from the base towards a top end of the plastic bottle;

(c) a finish region extending about the axis of the plastic bottle from the body to the top end of the plastic bottle; and (d) a composition contained in the plastic bottle, wherein the plastic bottle is pressurized to at least about 80 psig, wherein, when the plastic bottle is filled with the composition and pressurized, the plastic bottle is supported only in the finish region such that the base of the plastic bottle is substantially free of stress cracks, and wherein the plastic bottle is supported only by a holder positioned to a ring in the finish region when the plastic bottle is filled with the composition and pressurized such that the base of the plastic bottle is substantially free of stress cracks.

* * * * *